US009385485B2

(12) United States Patent
Hsu et al.

(10) Patent No.: US 9,385,485 B2
(45) Date of Patent: Jul. 5, 2016

(54) METHOD AND APPARATUS FOR TERMINATING WIRE WOUND MAGNETIC CORE

(71) Applicant: FOXCONN INTERCONNECT TECHNOLOGY LIMITED, Grand Cayman (KY)

(72) Inventors: Chih-Ching Hsu, New Taipei (TW); Yong-Chun Xu, Kunshan (CN); Zhi-Hui Tang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/570,102

(22) Filed: Dec. 15, 2014

(65) Prior Publication Data

US 2015/0171564 A1 Jun. 18, 2015

(30) Foreign Application Priority Data

Dec. 13, 2013 (CN) ..... 2013 1 0673760

(51) Int. Cl.

| | |
|---|---|
| ***H01R 13/66*** | (2006.01) |
| ***H01R 24/64*** | (2011.01) |
| *H01R 13/717* | (2006.01) |
| *H01R 13/6461* | (2011.01) |

(52) U.S. Cl.

CPC ..... *H01R 13/665* (2013.01); *H01R 24/64* (2013.01); *H01R 13/6461* (2013.01); *H01R 13/6633* (2013.01); *H01R 13/717* (2013.01)

(58) Field of Classification Search

CPC ..... H01R 13/6658; H01R 13/6625; H01R 23/025; H01R 23/005; H05K 1/0228

USPC ..... 439/620.22, 676, 668, 620.05–620.21

See application file for complete search history.

(56) References Cited

U.S. PATENT DOCUMENTS

| | | | | |
|---|---|---|---|---|
| 5,736,910 | A * | 4/1998 | Townsend | H01R 13/719 333/181 |
| 5,872,492 | A * | 2/1999 | Boutros | H01R 13/719 333/182 |
| 6,102,741 | A | 8/2000 | Boutros et al. | |
| 6,328,595 | B1 * | 12/2001 | Chang | H01R 13/6641 439/490 |
| 6,390,851 | B1 | 5/2002 | Belopolsky et al. | |
| 6,547,598 | B1 * | 4/2003 | Chen | H01R 13/6633 439/620.17 |
| RE38,519 | E * | 5/2004 | Doorhy | H01R 4/2433 439/404 |
| 6,811,442 | B1 * | 11/2004 | Lien | H01R 13/719 439/620.07 |

(Continued)

FOREIGN PATENT DOCUMENTS

| | | | |
|---|---|---|---|
| CN | 201355713 | Y | 12/2009 |
| CN | 20293067 | U | 5/2013 |

(Continued)

*Primary Examiner* — Abdullah Riyami
*Assistant Examiner* — Vladimir Imas
(74) *Attorney, Agent, or Firm* — Ming Chieh Chang; Wei Te Chung

(57) ABSTRACT

A modular jack has a magnetic assembly including insulative body, two rows of terminals retained to the insulative body, four transformers, and four common mode chokes. Each of the transformer and common mode choke includes a magnetic core and a plurality of conductive wires wound therearound. Each terminal has a recess for receiving an end portions of a corresponding wire and then the terminal is inserted into a through-hole of an internal printed circuit board for dip soldering. Guiding of the wire to the recess can be automated in contrast to manual winding operation.

17 Claims, 3 Drawing Sheets

(56) References Cited

U.S. PATENT DOCUMENTS 6,957,982 B1 * 10/2005 Hyland ..... H01R 24/64 439/490
6,986,684 B1 * 1/2006 Lien ..... H01R 24/64 439/620.07
7,040,927 B1 * 5/2006 Liu ..... H01R 24/64 439/490
7,153,163 B2 * 12/2006 Lewis ..... H01F 19/08 439/620.11
7,367,851 B2 * 5/2008 Machado ..... H01R 13/514 439/620.06
7,387,538 B2 * 6/2008 Engel ..... H01R 13/6658 439/620.23
7,485,004 B2 * 2/2009 Liu ..... H01R 12/58 439/620.25
7,670,183 B2 * 3/2010 Huang ..... H01R 13/6633 439/620.05
7,708,594 B2 * 5/2010 Xu ..... H01R 13/6658 439/620.05
8,439,705 B2 5/2013 Zhang
8,449,332 B2 * 5/2013 Purkis ..... H01R 24/64 439/620.06
8,475,213 B2 * 7/2013 Wang ..... H01R 13/6585 439/620.05
8,535,100 B2 * 9/2013 Ge ..... H01R 13/6658 439/620.17
8,545,274 B2 * 10/2013 Purkis ..... H01R 24/64 439/668
9,101,071 B2 * 8/2015 Wu ..... H05K 1/165
9,130,315 B2 * 9/2015 O'Malley ..... H01R 13/6469
2003/0100225 A1 5/2003 Aeschbacher et al.
2010/0062645 A1 * 3/2010 Chow ..... H01R 13/6633 439/620.22
2011/0059647 A1 * 3/2011 Machado ..... H01R 13/514 439/488
2012/0309233 A1 * 12/2012 O'Malley ..... H01R 13/6469 439/626

FOREIGN PATENT DOCUMENTS

TW M446405 U 7/2012
TW M444682 U 1/2013

* cited by examiner

METHOD AND APPARATUS FOR TERMINATING WIRE WOUND MAGNETIC CORE

BACKGROUND OF THE INVENTION

1. Field of the Invention

The present invention relates to the field of network conditioning assembly having terminals and magnetic cores with winding wires, and more specifically to retaining end portions of the wires to the terminals.

2. Description of Related Art

U.S. Pat. No. 8,439,705, issued to Zhang on May 14, 2013, discloses an electrical connector having an insulative housing and a terminal module. The terminal module includes an insulative body, an internal printed circuit board (PCB), a plurality of signal conditioning components, e.g., transformers, common mode chokes, etc., and a plurality of terminals connected to both of the PCB and the signal conditioning components. The component includes a magnetic core and a plurality of wires wound around the core. End portions of the wires wind around top portions of the terminals and then the top portions are soldered to conductive apertures or via of the PCB. Winding operation of the wires to the terminals are not performed by an automatic machine but done by manual labor, which is time-consuming and prone to breakage.

An electrical connector having a simple structure is desired.

SUMMARY OF THE INVENTION

The present invention provides an electrical connector comprising a magnetic assembly. The magnetic assembly includes an insulative body, a plurality of contacts, a plurality of leads, a plurality of signal conditioning components, and a printed circuit board (PCB). The insulative body has a front wall, a rear wall, two oppositely facing side walls between the front wall and the rear wall, and a receiving slot surrounded by said walls. Each contact has a first connecting portion extending outwardly along the front wall. Each lead has a second connecting portion extending outwardly along the rear wall. Each signal conditioning component has a magnetic core and a plurality of conductive wires wound thereabout to define a transformer or a common mode choke. The magnetic cores are received within the receiving slot. Each conductive wire has a first distal portion connecting to the first connecting portion and a second distal portion connecting to the second connecting portion. The PCB defines a plurality of conductive apertures for the first and second connecting portion inserted therethrough. Each of the first and second connecting portions defines a recess to receive one of the first and second distal portions of the conductive wires. The distal portions of the conductive wires extend across the conductive apertures, and the distal portions are retained to corresponding connecting portions through dipping into a solder pool for soldering. Therefore, the distal portions of the conductive wires need not to wind around the contacts and leads, and the distal portions can be guide to the recesses through an automachine. It needs only one soldering process that soldering the conductive wires to the contacts and soldering the contacts to the PCB.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
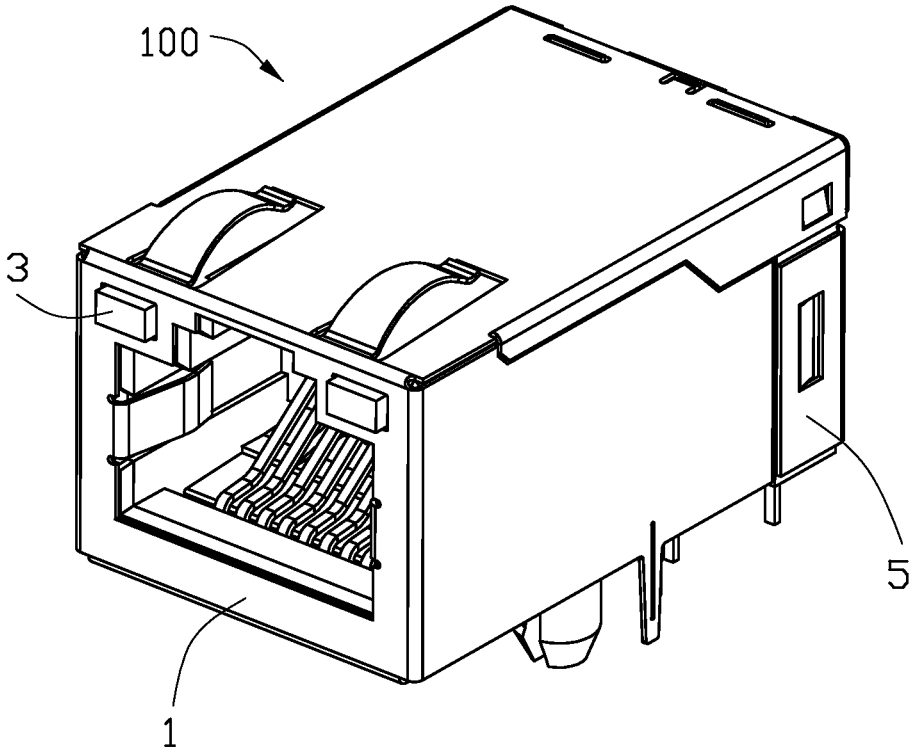
FIG. 1 is a perspective view of an embodiment of an electrical connector.
Figure 2:
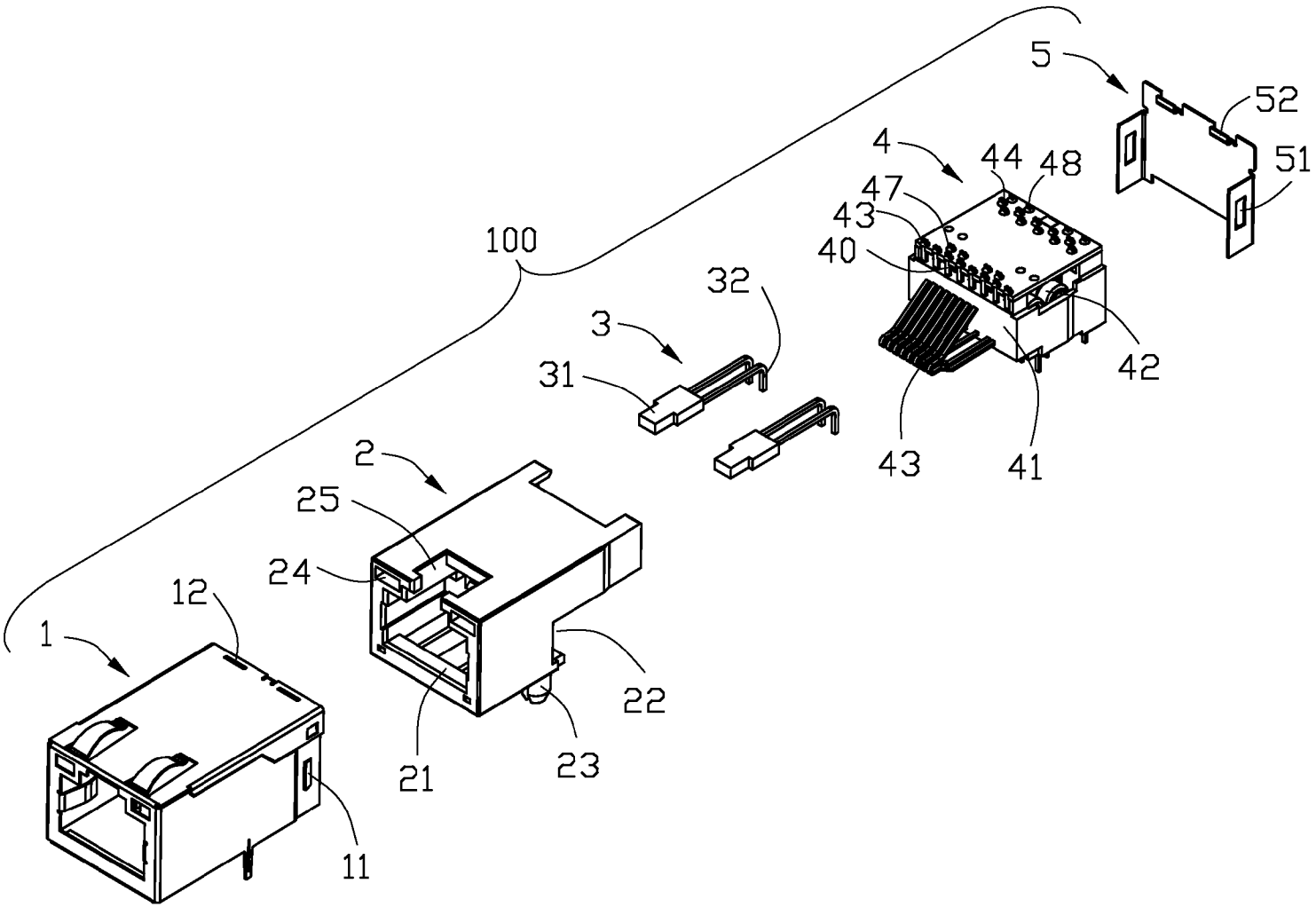
FIG. 2 is an exploded view of the electrical connector as shown in FIG. 1.
Figure 3:
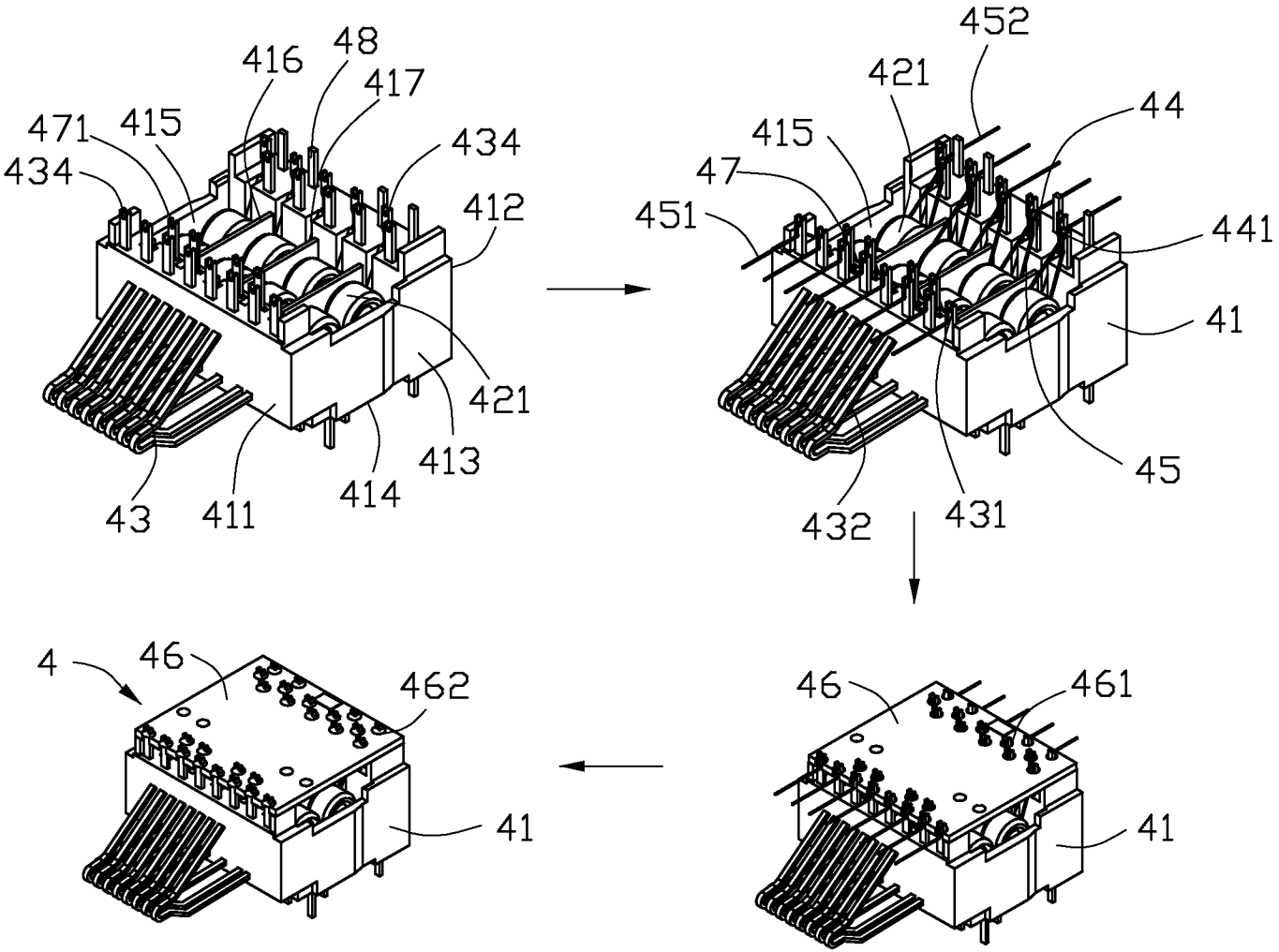
FIG. 3 is a manufacturing flow chart of a magnetic assembly shown in FIG. 2.

Referring to FIGS. 1-3, an electrical connector 100 in accordance with the embodiment of the present invention can be mounted to an exterior mother board (not shown). The electrical connector 100 includes a front metallic shell 1, an insulative housing 2, a pair of light emitting devices 3, a magnetic assembly 4, and a rear metallic shell 5.

The insulative housing 2 is formed by injection molding and shaped substantially rectangular. The insulative housing 2 has a plug-receiving cavity 21 extending inwardly from a front face, a mounting port 22 extending forwardly from a rear face, a pair of mounting posts 23 projecting downwardly from a bottom face, a receiving passage 24 located above the plug receiving cavity 21, and a latching hole 25 recessed from a top face. The mounting port 22 communicates with the plug-receiving cavity 21 on the interior of the insulative housing 2. The plug-receiving cavity 21 is configured to receive a modular plug. The magnetic assembly 4 is mounted to the mounting port 22 along a back-to-front direction. The mounting posts 23 are inserted into through-holes of the exterior mother board. The light emitting devices 3 are inserted within the receiving passage 24. The latching hole 25 locks with the tail of the modular plug.

The magnetic assembly 4 includes an insulative body 41, a plurality of signal conditioning components 42, a plurality of contacts 43, a plurality of leads 44, and a printed circuit board (PCB) 46. The insulative body 41 includes a front wall 411, a rear wall 412, two oppositely facing side walls 413 between the front wall 411 and the rear wall 412, a bottom wall 414, and a receiving slot 415 surrounded by the walls. The contact 43 has a first retention portion (not shown) retained in the front wall 411, a first connecting portion 431 projecting upwardly from a top section of the front wall 411, and a mating portion 432 exposed in the plug-receiving cavity 21. The lead 44 has a second retention portion (not shown) retained in the rear wall 412, a second connecting portion 441 projecting upwardly along the rear wall 412, and a mounting portion 442 extending downwardly beyond the bottom wall 414. The mounting portions 442 are mounted onto the mother board. Each of the first and second connecting portion 431, 441 defines a receiving recess 434 recessed downwardly from a top distal thereof. The contacts 43 and leads 44 are insert molded with the insulative body 41. The contacts 43 have eight contacts arranged in a row, and the leads 44 have ten leads arranged in two rows. The leads 44 have eight leads corresponding to the eight contacts and two other leads including one grounding lead and one power connecting lead. The magnetic assembly 4 also includes four center tap pins 47 located behind the contacts 43. Moreover, four LED pins 48 are located behind the leads 44. The center tap pins 47 connect with corresponding center tap wire distals of the transformers. In the shown embodiment, the center tap pins 47 are retained to the front wall 411, alternatively they could also be retained to the side walls 413.

The insulative body 41 also has a set of middle walls 416 disposed within the receiving slot 413 to divide the receiving slot 415 into a plurality of container chambers. Each conditioning component 42 has a magnetic core 421 and a plurality of conductive wires 45 wound therearound to define a transformer or a common mode choke. Each container chamber receives two conditioning components 42 comprising one transformer and one common mode choke. Each conductive wire 45 has a first distal portion 451 connecting to the first connecting portion 431 and a second distal portion 452 connecting to the second connecting portion 441. The first distal portion 451 is received in the recess 434 of the first connecting portion 431. The second distal portion 452 is received in the recess 434 of the second connecting portion 441. Each of the center tap pin 47 has a similar receiving recess 471 as the contacts 43 to receive the first distal portion 451 of the conductive wire 45.

The PCB 46 defines a plurality of conductive apertures 461 extending through the PCB 46 along a top-to-bottom direction. The distal portions 451, 452 of the conductive wires 45 extend across the conductive apertures 461 and are received in the recesses 434 of the first and second connecting portion 431, 441. The distal portions 451, 452 are retained to corresponding connecting portions 431, 441 by dipping into a solder pool (not shown) for soldering.

The PCB 46 has a plurality of electronic component such as resistors and capacitors (not shown) mounted thereon. The PCB 46 are disposed above the insulative body 41 and disposed horizontally along a front-to-back direction. The first and second connecting portions 431, 441 extend upwardly beyond the PCB 46.

The front metallic shell 1 has a locking tab 11 projecting outwardly from a side face thereof, and a through-hole 12 extending vertically from a top face thereof. The rear metallic shell 5 has an engaging hole 51 extending transversely from a side face thereof to lock with the locking tab 11, and an engaging tap 52 projecting upwardly to inert in the through-hole 12.

The light emitting device 3 includes a lighting portion 31 and two conductive terminals 32 extending backwardly. The LED pins 48 electrically connect with corresponding conductive terminals 32 of the light emitting devices 3 through the PCB 46. In the shown embodiment, the pins 48 are retained to the rear wall 411, alternatively they could also be removed from the rear wall 412 and instead formed as a portion of the conductive terminals 32, which are not retained to the insulative body 41.

Referring to FIG. 3, a method of manufacturing the electrical connector 100 comprises: (a) providing a carrier including an insulative body 41 having a front wall 411 and a rear wall 412 with a receiving slot 415 between the front and rear walls, a plurality of contacts 43 retained on the front wall 411, and a plurality of leads 44 retained on the rear wall 412, each of the contacts 43 and the leads 44 defining a recess 434; (b) providing a plurality of conditioning components 42 each having a magnetic core 421 and a plurality of conductive wires 45 wound therearound to form a transformer or a common mode choke, each conductive wire 45 having a first distal portion 451 and an opposite second distal portion 452; (c) disposing the magnetic cores 421 into the receiving slot 415, routing the first distal portion 451 of the conductive wire 45 across the recess 434 of the contact 43, and the second distal portion 452 of the conductive wire 45 across the recess 434 of the lead 44; (d) providing a PCB 46 defining a plurality of conductive apertures 461, and mounting the PCB 46 to the contacts 43 and leads 44 under condition that the distal portions 451, 452 of conductive wires 45 together with the contacts 43 and the leads 44 insert across the corresponding aperture 461; (e) providing a solder pool (not shown) with soldering flux, and dipping the recesses 434 of the contacts 43 and the leads 44 into the solder pool to solder and retain the conductive wires 45 to the contacts 43 and the leads 44.

The step of soldering the conductive wires 45 also forms conductive pads 462 onto the conductive apertures 461 for electrical connection the contacts 43 and the leads 44 with the PCB 46.

The method of manufacturing the electrical connector 100 further comprises: (f) cutting the excessive ends of the conductive wires to form the magnetic assembly 4; (g) assembling the magnetic assembly 4 to the mounting port 22 of the insulative housing 2; (h) assembling the front metallic shell 1 and the rear metallic shell to insulative housing 2 for forming the electrical connector 100.

The shown embodiment is an RJ45 connector. Understandably, the electrical connector 100 could be embodied in a LAN (local area network) transformer mounted on a mother board or on an inner PCB of an RJ45.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a magnetic assembly having:

an insulative body having a front wall, a rear wall, two oppositely facing side walls between the front wall and the rear wall, and a receiving slot surrounded by said walls;

a plurality of contacts each having a first retention portion retained in the front wall and a first connecting portion extending outwardly along the front wall;

a plurality of leads each having a second retention section retained in the rear wall and a second connecting portion extending outwardly along the rear wall;

a plurality of signal conditioning components each having a magnetic core and a plurality of conductive wires wound around the core, the magnetic cores received within the receiving slot, the conductive wires including a plurality of first distal portions connecting to the first connecting portions and a plurality of second distal portions connecting to the second connecting portions; and a printed circuit board (PCB) defining a plurality of conductive apertures for the first and second connecting portions to insert through; wherein each of the first and second connecting portions defines a recess to receive a corresponding one of the first and second distal portions of the conductive wires, the distal portions of the conductive wires extend across the conductive apertures, and the distal portions are soldered to corresponding connecting portions;

the PCB is disposed above the insulative body and disposed horizontally along a front-to-back direction;

said first and second connecting portions extend upwardly beyond the PCB, said recess of the connecting portion located on a top thereof; and said recesses of the first and second connecting portions are recessed downwardly.

2. The electrical connector as claimed in claim 1, wherein the insulative body has a set of middle walls within the receiving slot to divide the receiving slot into a plurality of container chambers, each container chamber receiving one transformer and one common mode choke.

3. A method of manufacturing an electrical connector, comprising the steps of:

providing a carrier, the carrier including an insulative body having a front wall and a rear wall with a receiving slot between the front and rear walls, a plurality of contacts retained on the front wall, and a plurality of leads retained on the rear wall, each of the contacts and the leads defining a recess;

providing a plurality of conditioning components each having a magnetic core and a plurality of conductive wires wound therearound;

disposing the magnetic cores into the receiving slot, routing first distal portions of the conductive wires across the recesses of the contacts, and routing second distal portions of the conductive wires across the recesses of the leads;

providing a printed circuit board (PCB) defining a plurality of conductive vias, and mounting the PCB to the contacts and leads so as to insert the distal portions of the conductive wires received in the recesses across corresponding vias from a side of the PCB to the other opposite side of the PCB; and dipping the recesses of the contacts and the leads into a solder pool to solder and retain the distal portions to the contacts and the leads.

4. The method as claimed in claim 3, further comprising a step of cutting excessive free ends of the distal portions.

5. The method as claimed in claim 3, wherein the step of dipping comprises forming conductive pads onto the conductive apertures for electrically connecting the contacts and the leads with the PCB.

6. The method as claimed in claim 3, wherein the step of mounting the PCB comprises disposing the PCB above the insulative body and horizontally along a front-to-back direction.

7. The method as claimed in claim 6, wherein the step of providing the carrier comprises retaining each contact in the front wall and extending a first connecting portion of the contact upwardly from the front wall, retaining each lead in the rear wall and extending a second connecting portion of the lead upwardly from the rear wall, and disposing said recesses on top free ends of the connecting portions.

8. The method as claimed in claim 7, wherein said first and second connecting portions extend upwardly beyond the PCB.

9. The method as claimed in claim 8, wherein said recesses of the first and second connecting portions are recessed downwardly.

10. The method as claimed in claim 4, wherein said magnetic assembly is mounted to an insulative housing to be a RJ45.

11. The method as claimed in claim 4, wherein said magnetic assembly is functioned as a Lan transformer mounted to an exterior mother PCB or an inner PCB of a RJ45.

12. An electrical connector comprising:

an insulative housing defining a mating cavity forwardly communicating with an exterior in a front-to-back direction;

a magnetic assembly assembled into the housing and including:

an insulative body with therein a receiving slot located behind a connecting face to communicate with the exterior in a vertical direction perpendicular to said front-to-back direction;

a plurality of contacts forming corresponding mating sections extending into the mating cavity and corresponding connecting sections exposed around the connecting face;

a plurality of signal conditioning components disposed in the receiving slot, each of said signal conditioning components including a magnetic core and a plurality of conductive wires wound thereon, each of said wires including at least one end mechanically and electrically connected to the connecting section of the corresponding contact; and an inner printed circuit board positioned upon the connecting face to veil the receiving slot and defining a plurality of through holes therein; wherein the connecting section defines a recess, in which said end of the wire is snugly received, and extends through the corresponding through hole, and a secured fixation between the wire and the connecting section, and that between the connecting section and the inner printed circuit board are both implemented via only one dip-soldering process.

13. The electrical connector as claimed in claim 12, further including a plurality of footer pins each including a corresponding recess around the connecting face to receive the other end of the corresponding wire and extending through the corresponding hole so as to have a secured fixation between the wire and the footer pin and that between the footer pin and the printed circuit board are both implemented via only one dip-soldering process.

14. The electrical connector as claimed in claim 12, wherein the footer pins and the contacts are located by two opposite sides of the insulative body, respectively.

15. The electrical connector as claimed in claim 12, wherein said magnetic core has a donut-like shape.

16. The electrical connector as claimed in claim 12, wherein said signal conditioning components directly face the printed circuit board in said vertical direction.

17. The electrical connector as claimed in claim 12, wherein each of said footer pins extend beyond a mounting face of the insulative body opposite to said connecting face in the vertical direction for mounting to a main body.

* * * * *